United States Patent [19]

Woodworth et al.

[11] Patent Number: 4,657,134

[45] Date of Patent: Apr. 14, 1987

[54] COMPARTMENTED PACKAGE

[75] Inventors: John L. Woodworth, Hopkinton; John M. Lynch, Paxton, both of Mass.

[73] Assignee: Kidde, Inc., Saddle Brook, N.J.

[21] Appl. No.: 813,415

[22] Filed: Dec. 26, 1985

[51] Int. Cl.[4] ..... B65D 30/22

[52] U.S. Cl. ..... 206/219; 206/216; 53/449; 383/37; 383/38

[58] Field of Search ..... 206/216, 219, 221, 222, 206/538, 539; 53/449, 469; 383/37, 38

[56] References Cited

U.S. PATENT DOCUMENTS

| | | | |
|---|---|---|---|
| 2,382,978 | 8/1945 | Curry | 206/221 |
| 2,687,130 | 8/1954 | Cohen | 206/222 |
| 3,255,923 | 6/1966 | Soto | 383/38 |
| 3,359,361 | 12/1967 | Oakman | 206/219 |
| 3,479,802 | 11/1969 | Fesco | 383/38 |
| 3,573,069 | 3/1971 | Keller et al. | 206/219 |
| 3,756,390 | 9/1973 | Abbey et al. | 206/219 |
| 3,950,158 | 4/1976 | Gossett | 206/219 |
| 4,540,089 | 9/1985 | Maloney | 383/38 |

*Primary Examiner*—William Price
*Assistant Examiner*—Brenda J. Ehrhardt
*Attorney, Agent, or Firm*—John E. Toupal; Harold G. Jarcho

[57] ABSTRACT

A compartmented package including an outer container having a side wall portion joining an outer closed end and an outer sealed fill end, the outer container defining a first chamber portion adjacent to the outer closed end and a second chamber portion adjacent to the outer fill end, the first and second chamber portions being spaced apart in a direction extending between the outer closed and fill ends and the outer container further defining a stop surface; a first fluid substance retained in the first chamber portion of said outer container; an inner container retained in the second chamber portion of the outer container and having an inner closed end and an inner sealed fill end, the inner container defining an abutment surface engaging the stop surface so as to prevent movement of the inner container into the first chamber portion of the outer container; and a second fluid substance retained in the inner container and sealed from the first fluid substance.

15 Claims, 5 Drawing Figures

FIG. 1
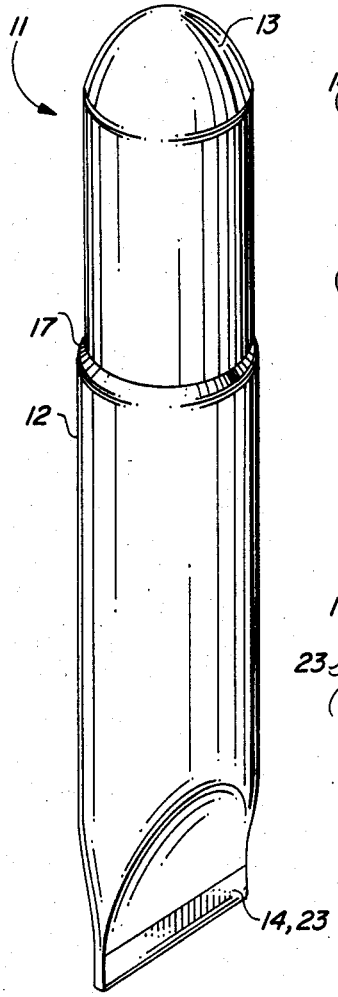
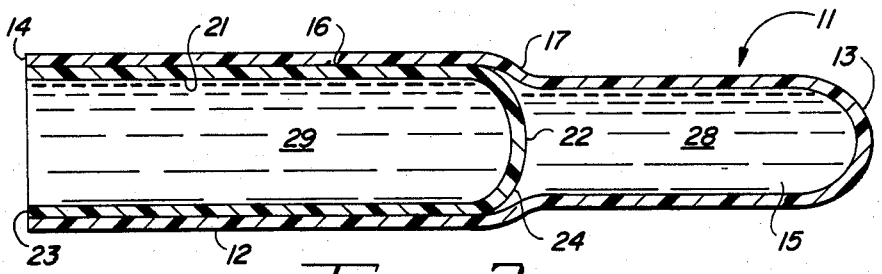
FIG. 2
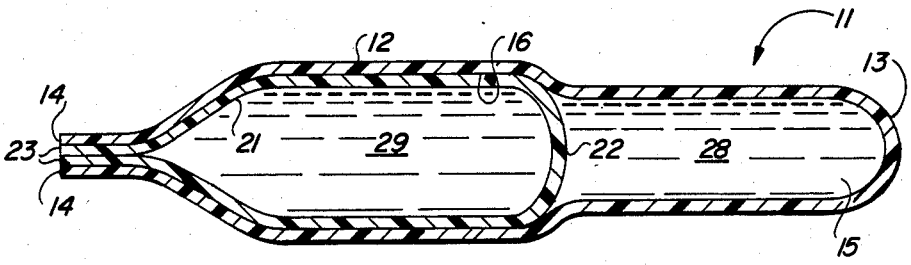
FIG. 3
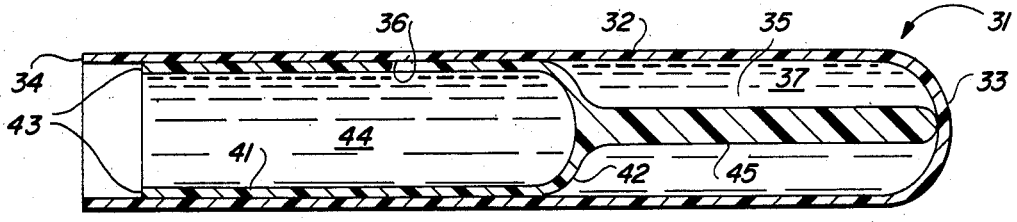
FIG. 4
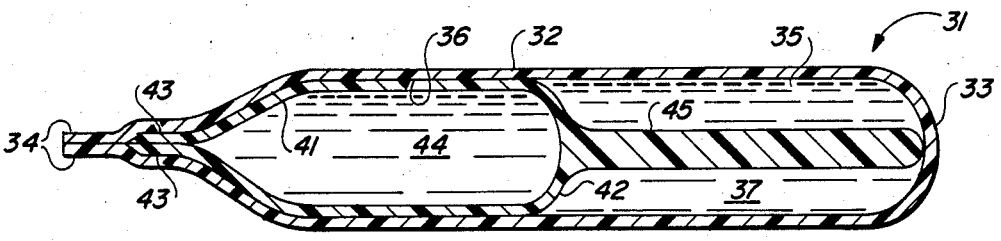
FIG. 5

COMPARTMENTED PACKAGE

BACKGROUND OF THE INVENTION

This invention relates generally to a compartmented package for sequentially storing, mixing and dispensing fluids.

The invention is suitable for use in connection with the many materials which are mixed together immediately before use. Particular utility for the invention is for the dispensing of mixed fluids which must be kept separated until immediately before use, such as light producing chemicals, various pharmeceutical compositions, insecticides, the components of photographic developers, two component plastic adhesives and coatings, etc.

Although many types of compartmented packages have been provided and proposed for the above noted applications, they exhibit either individually or collectively certain difficiencies. For example, the labor and equipment costs entailed for producing multi-component packages generally exceeds substantially the cost of the components per se. A need exists, therefore, for compartmented packages that can reduce the ultimate cost of a finished multi-component packaged product.

The object of this invention is to provide an improved, less expensive compartmented package for plural components that are to be separately stored and then combined for use.

SUMMARY OF THE INVENTION

The invention is a compartmented package including an outer container having a side wall portion joining an outer closed end and an outer sealed fill end, the outer container defining a first chamber portion adjacent to the outer closed end and a second chamber portion adjacent to the outer fill end, the first and second chamber portions being spaced apart in a direction extending between the outer closed and fill ends and the outer container further defining a stop surface; a first fluid substance retained in the first chamber portion of said outer container; an inner container retained in the second chamber portion of the outer container and having an inner closed end and an inner sealed fill end, the inner container defining an abutment surface engaging the stop surface so as to prevent movement of the inner container into the first chamber portion of the outer containcr; and a second fluid substance retained in the inner container and sealed from the first fluid substance. Filling and sealing of the package is facilitated by the provision of stop and abutment surfaces that accurately position the inner container within the outer container.

In one embodiment of the invention, the outer and inner sealed ends are juxtaposed and heat sealed as a common seal. This arrangement simplifies the sealing process after filling of the individual containers.

In another embodiment of the invention, the inner and outer containers are formed from incompatible sealable materials and the inner sealed end is at least partially encompassed by the outer sealed end. This arrangement simplifies the sealing process where different container materials are desired.

According to one feature of the invention, the stop surface comprises a reduced inner dimensional section of the side wall portion and the abutment surface comprises an outer peripheral portion of the inner container.

This arrangement provides the desired stop and abutment surfaces in an easily manufactured form.

According to a different feature of the invention, the stop surface comprises the closed end of the outer container and the abutment surface comprises a projection portion of the inner container extending from the closed end thereof and through the first chamber portion. This arrangement provides the stop and abutment surfaces in another easily manufactured form.

According to still another feature of the invention, the inner and outer containers are flexible walled tubes. The flexible walls facilitate mixing of the plural ingredients prior to their use.

The invention further encompasses a method for producing a compartmented package and including as one step the forming of an outer container having an outer closed end, an outer open end, a side wall portion joining the outer open and closed ends, and a stop surface; the outer container defining a first chamber portion adjacent to the outer closed end and a second chamber portion adjacent to the outer open end. Additional steps entail forming an inner container having an inner closed end, an inner open end, and an abutment surface and filling the first chamber portion of the outer container with a first fluid substance. Final steps of the method consist of inserting the inner container into the second chamber portion of the outer container so as to produce engagement between the stop surface and the abutment surface; filling the inner container with a second fluid substance; and sealing the inner and outer open ends to secure the inner container within the outer container and to seal the first and second substance, respectively, within the outer and inner containers. The disclosed method greatly simplifies the filling and sealing of a compartmented package with different isolated ingredients which are to be mixed prior to use.

DESCRIPTION OF THE DRAWINGS

These and other objects and features of the invention will become more apparent upon a perusal of the following description taken in conjunction with the accompanying drawings wherein:

FIG. 1 is a perspective view of a compartmented package according to the invention;

FIG. 2 is a schematic cross-sectional view of the package shown in an unsealed condition;

FIG. 3 is a schematic cross-sectional view of the package shown in a sealed condition;

FIG. 4 is a schematic cross-sectional view of a modified embodiment of the invention shown in an unsealed condition; and FIG. 5 is a schematic cross-sectional view of the FIG. 4 embodiment shown in a sealed condition.

DESCRIPTION OF THE PREFERRED EMBODIMENT

A compartmented package 11 according to this invention is illustrated in FIGS. 1–3. Included in the package 11 is an outer tubular container 12 having an outer closed end 13 and an outer open end 14 (FIG. 2) that after being used for filling is sealed as shown in FIG. 3. Defined by the outer container 12 is a first chamber portion 15 adjacent to the closed end 13 and a second chamber portion 16 adjacent to the open end 14 and spaced from the first chamber portion 15 in a direction therebetween. The portion of the outer container sidewall that defines the first chamber portion 15 is of reduced inner diameter relative to the inner diameter of the sidewall portion defining the second chamber 16. Formed by that reduced dimensional section of the outer container 12 is an annular inner shoulder that forms a stop surface 17.

An additional component of the compartmented package 11 is an inner tubular container 21 having an inner closed end 22 and an inner open end 23 (FIG. 2). After filling of the inner container 21, the open end 23 also is sealed as shown in FIG. 3. The inner container 21 is retained within the second chamber portion 16 of the outer container 12. Defined by an outer periphery 24 of the closed end 22 of the inner container 21 is an annular abutment surface 24 that engages the shoulder stop 17 located between the first chamber portion 15 and the second chamber portion 16.

In accordance with a preferred method of producing the compartmented package 11, the outer container 12 and the inner container 21 are injection molded from compatible materials having characteristics required for efficient heat sealing. The first chamber portion 15 of the outer container 12 then is filled with a first fluid substance 28. Next, the inner container 21 is inserted into the second chamber portion 16 of the outer container 12 until the abutment surface 24 on the inner closed end 22 engages the shoulder stop 17. Then the inner container 21 is filled with a second fluid substance 29 that is to be ultimately combined with the first fluid substance 28. Finally, conventional heat sealing equipment is utilized to provide a common seal between the juxtaposed open ends 14 and 23 and thereby seal and isolate the first and second fluid substances 28 and 29.

Because of the accurate positioning of the inner container 21 within the outer container 12 provided by the abutment surface 24 and the stop surface 17, inadvertent movement of the inner container 21 into the first chamber portion 15 of the outer container 12 is prevented. Such inadvertent penetration of the inner container 21 could force a quantity of the first fluid substance 28 into the second chamber portion 16 of the outer container 12 and prevent the attainment of a tight heat seal between the open ends 14 and 23.

Illustrated in FIGS. 4 and 5 is another compartmented package embodiment 31 of the invention. An outer tubular container 32 of uniform diameter has a closed end 33 and an open end 34. Defined by the outer container 32 between the ends 33 and 34 are a first chamber portion 35 and a second chamber portion 36. After filling of the first chamber portion 35 with a first fluid substance 37, the open end 34 is sealed as shown in FIG. 5.

Retained within the second chamber portion 36 of the outer container 32 is an inner tubular container 41 having an outer diameter substantially equal to the inner diameter of the outer container 32. The inner container 41 has a closed end 42 and an open end 43 (FIG. 4) which is sealed as shown in FIG. 5 after filling of the inner container 41 with a second fluid substance 44. Extending from the closed end 42 is a projection 45 that extends through the first chamber portion 35 and engages a stop surface defined by the closed end 33 of the outer container 32.

Production of the compartmented package 31 is similar to that of the compartmented package 11 except that the inner container 41 and the outer container 32 are preferably injection molded from materials that are not compatible for common heat sealing operations. Dissimilar materials for the outer and inner containers 32 and 41 can be desirable where unique performance characteristics are required. For example, in certain applications, the inner container 41 would be formed from a material susceptible to stress fracture that could be induced when mixing of the first and second fluid substances 37 and 44 is desired.

During assembly of the compartmented package 31, the first chamber portion 35 of the outer container 32 first is filled with the first fluid substance 37. Then the inner container 41 is inserted into the second chamber portion 36 of the outer container 32 until the projection 45 engages the closed end 33. Engagement of the projection 45 with the closed end 33 accurately positions the inner container 41 within the second chamber portion 36 of the outer container 32 and prevents forcible discharge of the first fluid substance 37. After filling of the inner container 41 with the second fluid substance 44 the juxtaposed open ends 34 and 43 are heat sealed. However, in this instance, because of the dissimilar materials utilized, a tight common seal cannot be created between the open ends 34 and 43. Accordingly, the open end 34 of the outer container 32 includes portions that extend beyond the open end 43 of the inner container 41 and those extended portions 47 are heat sealed together to provide an outer seal that partially encompasses the simultaneously created heat seal of the inner end 43.

Obviously, many modifications and variations of the present invention are possible in light of the above teachings. It is to be understood, therefore, that the invention can be practiced otherwise than as specifically described.

What is claimed:

1. A compartmented package comprising:

an outer container having a side wall portion joining an outer closed end and an outer fill end with sealed together outer wall portions forming a fluid tight outer seal, said outer container defining a first chamber portion adjacent to said outer closed end and a second chamber portion adjacent to said outer fill end, said first and second chamber portions being spaced apart in a direction extending between said outer closed and fill ends, and said outer container further defining a stop surface;

a first fluid substance retained in said first chamber portion of said outer container;

an inner container retained in said second chamber portion of said outer container and having an inner closed end and an inner fill end with inner wall portions commonly sealed with said outer wall portions to form a fluid tight inner seal, said inner container defining an abutment surface engaging said stop surface so as to prevent movement of said inner container into said first chamber portion of said outer container; and a second fluid substance retained in said inner container and sealed from said first fluid substance.

2. A compartmented package according to claim 1 wherein said inner and outer sealed ends are heat sealed.

3. A compartmented package according to claim 1 wherein said inner and outer containers are formed from incompatible sealable materials and said inner sealed end is only partially encompassed by said outer sealed end.

4. A compartmented package according to claim 3 wherein said inner and outer sealed ends are heat sealed.

5. A compartmented package according to claim 1 wherein said inner and outer containers are flexible walled tubes.

6. A compartmented package according to claim 1 wherein said stop surface comprises a reduced inner dimensional section of said side wall portion of said outer container, and said abutment surface comprises an outer peripheral portion of said inner container.

7. A compartmented package according to claim 6 wherein said inner and outer containers are flexible walled tubes and said inner dimensions of said second chamber portion are substantially equal to the outer dimensions of said inner container.

8. A compartmented package according to claim 7 wherein said stop surfaces comprise an annular shoulder formed by a reduced diameter portion of said side wall portion.

9. A compartmented package according to claim 1 wherein said stop surface comprises said closed end of said outer container, and said abutment surface comprises a projection portion of said inner container extending from said closed end thereof and through said first chamber portion.

10. A compartmented package according to claim 9 wherein said inner and outer containers are flexible walled tubes.

11. A method for producing a compartmented package comprising the steps of:

forming an outer container having an outer closed end, an outer open end, a side wall portion joining said outer open and closed ends, and a stop surface; said outer container defining a first chamber portion adjacent to said outer closed end and a second chamber portion adjacent to said outer open end;

forming an inner container having an inner closed end, an inner open end, and an abutment surface;

filling said first chamber portion of said outer container with a first fluid substance;

inserting said inner container into said second chamber portion of said outer container so as to produce engagement between said stop surface and said abutment surface;

filling said inner container with a second fluid substance; and commonly sealing together inner wall portions and outer wall portions of, respectively, said inner and outer open ends to secure said inner container within said outer container and to seal said first and second substances, respectively, within said outer and inner containers.

12. A method according to claim 11 wherein said inner and outer containers are formed from incompatible sealable materials and said sealing step comprises simultaneously heat sealing said outer and inner open ends such that said sealed outer end only partially encompasses said sealed inner end.

13. A method according to claim 11 wherein said outer container is formed with a reduced inner dimensional section that provides said stop surface.

14. A method according to claim 13 wherein said inner and outer containers are flexible walled tubes, said inner dimensions of said second chamber portion are substantially equal to the outer dimensions of said inner container, and said stop surface is an annular shoulder formed by a reduced diameter portion of said side wall portion.

15. A method according to claim 11 wherein said outer closed end comprises said stop surface, said inner container comprises a projection portion extending from said inner closed end, and said inserting step comprises moving said projection portion through said first chamber portion to engage said outer closed end.

* * * * *